US007465389B2

(12) United States Patent
Sirota et al.

(10) Patent No.: US 7,465,389 B2
(45) Date of Patent: Dec. 16, 2008

(54) PRODUCTION OF EXTRA-HEAVY LUBE OILS FROM FISCHER-TROPSCH WAX

(75) Inventors: Eric Bart Sirota, Flemington, NJ (US); Jack Wayne Johnson, Clinton, NJ (US); Robert R. Simpson, Scotch Plains, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 461 days.

(21) Appl. No.: 11/156,313

(22) Filed: Jun. 17, 2005

(65) Prior Publication Data

US 2006/0006103 A1 Jan. 12, 2006

Related U.S. Application Data

(60) Provisional application No. 60/586,774, filed on Jul. 9, 2004.

(51) Int. Cl.

| | |
|---|---|
| ***C10G 21/16*** | (2006.01) |
| ***C10G 21/00*** | (2006.01) |
| ***C10G 21/12*** | (2006.01) |

(52) U.S. Cl. ..... 208/332; 208/96; 208/322; 208/950; 518/724

(58) Field of Classification Search ..... 208/96, 208/308, 311, 322, 332, 950; 518/724, 728
See application file for complete search history.

(56) References Cited

U.S. PATENT DOCUMENTS

| | | | | |
|---|---|---|---|---|
| 4,911,821 | A | 3/1990 | Katzer et al. | 208/27 |
| 6,420,618 | B1 | 7/2002 | Berlowitz et al. | 585/310 |
| 2004/0045868 | A1 | 3/2004 | Germaine | 208/58 |

FOREIGN PATENT DOCUMENTS

| | | | |
|---|---|---|---|
| WO | WO 02/70629 | A1 * | 9/2002 |
| WO | WO 2004/033596 | A2 | 4/2004 |

* cited by examiner

*Primary Examiner*—Glenn Caldarola
*Assistant Examiner*—Randy Boyer
(74) *Attorney, Agent, or Firm*—Estelle C. Bakun

(57) ABSTRACT

Extra heavy lube base stocks are separated from heavy lube oils with a polar solvent in an amount sufficient to form a first light phase and a second heavy phase. The phases are then separated and the solvent is removed from the second heavy phase to yield an extra heavy lube.

9 Claims, No Drawings

PRODUCTION OF EXTRA-HEAVY LUBE OILS FROM FISCHER-TROPSCH WAX

This application claims the benefit of U.S. Ser. No. 60/586,774 filed Jul. 9, 2004.

FIELD OF THE INVENTION

The present invention relates to the production of extra-heavy lube basestocks. More particularly, the invention relates to a method for separating extra heavy lube base stock material from a Fischer-Tropsch derived product.

BACKGROUND OF THE INVENTION

The Fischer-Tropsch process was developed in the 1920's as a way of producing hydrocarbons from synthesis gas, i.e., hydrogen and carbon monoxide. Initially, the process was centered on producing gasoline range hydrocarbons as automotive fuels. Today, however, the Fischer-Tropsch process is increasingly viewed as a method for preparing heavier hydrocarbons such as diesel fuels, and more preferably waxy molecules, for conversion to clean, efficient lubricants. Indeed, the importance of producing a product slate containing a higher carbon number distribution is ever increasing. A measure of the carbon number distribution is the Schulz-Flory alpha value, which represents the probability of making the next higher carbon number compound from a given carbon number compound. The Schulz-Flory distribution is expressed mathematically by the Schulz-Flory equation:

$$W_i=(1-\alpha)^2 i\alpha^{i-1}$$

where i represents carbon number, $\alpha$ is the Schulz-Flory distribution factor which represents the ratio of the rate of chain propagation to the rate of chain propagation plus the rate of chain termination, and $W_i$ represents the weight fraction of product of carbon number i. Alpha numbers above about 0.9 are, in general, representation of wax producing processes, and the higher the alpha number, e.g., as it approaches 1.0, the more selective the process is for producing wax molecules.

The waxy Fischer-Tropsch products, of course, have poor cold flow properties limiting their value unless converted into more useable products. Thus, the Fischer-Tropsch wax is subjected to treatments such as hydrotreating, hydroisomerization and hydrocracking to convert the wax to more valuable material. Hydroisomerization is particularly preferred treatment method for converting the wax to a more valuable material. Indeed, heavy lube basestocks are separated from the hydroisomerized material by high temperature distillation.

The practical usefulness of high temperature distillation in separating a slate of heavy lube base stocks is somewhat limited. Typically, high temperature distillation units are suitable for conducting distillation at temperatures up to about 1050° F. (566° C.) equivalent atmospheric boiling point. Commercial wiped-film evaporative distillation units can be used to raise the effective boiling range but are costly for large volume applications. Thus, there remains a need for an effective method for fractionating heavy lube molecules from isomerized Fischer-Tropsch wax.

Accordingly, an object of the present invention is to produce heavy lube base stocks from Fischer-Tropsch wax.

Another object of the invention is to provide a method for separating hydroisomerized Fischer-Tropsch wax into high viscosity fractions suitable as lube base stocks.

Other objects of the invention will become apparent from that herein which follows.

SUMMARY OF THE INVENTION

Broadly stated, extra heavy lube base stocks are separated from heavy lube oils by treating the heavy lube oils with a polar solvent in an amount sufficient to form a first light phase and a second heavy phase. The phases are then separated and the solvent is removed from the second heavy phase to yield an extra heavy lube.

In a particularly preferred embodiment the heavy lube oil is a 700° F.+ (371° C.) cut of a hydroisomerate obtained by catalytically hydroisomerizing a high $\alpha$, Fischer-Tropsch wax.

DETAILED DESCRIPTION OF THE INVENTION

The present invention provides a method for producing extra heavy lube base stocks from heavy lube oils. By extra heavy base stocks is meant lube base stocks having a viscosity greater than about 15 cSt at 100° C. By heavy lube oils is meant to be oils boiling in the range of about 850° F. (454° C.) to about 1200° F. (649° C.), or higher. In a preferred embodiment the heavy lube oil is obtained from a catalytically hydroisomerized hydrocarbon stream obtained by converting syngas under Fischer-Tropsch reaction conditions. Preferably the hydrocarbon stream is obtained by conducting a Fischer-Tropsch process under conditions sufficient to produce a product having a Schulz-Flory alpha, $\alpha$, greater than 0.9 and more preferably greater than 0.92.

Producing such high alpha material can be achieved in a number of ways. Typically, these involve at least one of (a) the appropriate selection of process operating conditions and (b) choice of catalyst.

In one preferred embodiment of the invention the Fischer-Tropsch process is conducted at temperatures no greater than 430° F. (221° C.), for example from about 300° F. to about 430° F. (148° C. to 221° C.). Operating pressures typically are in the range of from about 10 to about 600 psia and space velocities of about 100 to 10,000 cc/g/hr.

The Fischer-Tropsch process preferably is conducted in a slurry bubble column reactor. In slurry bubble column reactors catalyst particles are suspended in a liquid and gas is fed into the bottom of the reactor through a gas distributor. As the gas bubbles rise through the reactor the reactants are absorbed into the liquid and diffuse to the catalyst where they can be converted to both gaseous and liquid products. Gaseous products can be recovered at the top of the column and liquid products are recovered by passing the slurry through a filter which separates the solid catalyst from the liquid. An optimal method for operating a three phase slurry bubble column is disclosed in EP 450860 B1 which is incorporated herein by reference in its entirety.

Suitable Fischer-Tropsch catalysts comprise one or more Group VIII metals such as Fe, Ni, Co, and Ru on an inorganic oxide support. Additionally, the catalyst may also contain a promoter metal. One suitable catalyst for the process of the invention is cobalt promoted with rhenium supported on titania having a Re:Co weight ratio in the range of about 0.01 to 1 and containing about 2 to 50 wt % cobalt. Examples of such catalysts can be found in U.S. Pat. No. 4,568,663 (no binder); U.S. Pat. No. 4,992,406 ($Al_2O_3$ binder); and, U.S. Pat. No. 6,117,814 ($SiO_2$—$Al_2O_3$ binder).

In another embodiment of the invention the Fischer-Tropsch process is conducted with a catalyst which comprises cobalt and especially cobalt and rhenium on a support comprising primarily titania and a minor amount of cobalt aluminate. In general the support will contain at least 50 wt % titania and preferably from 80 to about 97 wt % titania based on the total weight of the support. About 20 to 100 wt %, and preferably 60 to 98 wt % of the titania of the support is in the rutile crystalline phase with the balance being the anatase crystalline phase or amorphous phases. The amount of cobalt aluminate in the binder is dependent upon the amount of cobalt and aluminum compounds used in forming the support. Suffice it to say that sufficient cobalt is present in the support to provide a cobalt/aluminum atomic ratio greater than 0.25, preferably from 0.5 to 2, and more preferably about 1. Thus, at a Co/Al ratio of 0.25 about half the aluminum oxide is present as cobalt aluminate. At a Co/Al ratio of 0.5 substantially all the alumina oxide present is present as cobalt aluminate. At Co/Al ratios above 0.5 the support will contain cobalt titanate in addition to cobalt aluminate and be essentially free of alumina.

The support is typically formed by spray drying a suitable aqueous slurry of titania, alumina binder material and optionally silica binder material into a purged chamber with heated air at an outlet temperature of about 105° C. to 135° C. Spray drying produces a spherical support with a size range of about 20 to 120 microns. This spray dried support is then calcined at temperatures in the range of 400 to 800° C., preferably about 700° C. Next the calcined material is impregnated with an aqueous solution of a cobalt compound, preferably cobalt nitrate, in an amount sufficient to convert, upon calcination, at least part of the alumina to cobalt aluminate. Preferably sufficient cobalt compound is used to convert from 50% to 99+% of the alumina to cobalt aluminate. Therefore, the amount of cobalt compound added during the preparation of the support will correspond to an atomic ratio of Co:Al in the range of 0.25:1 to 2:1 and preferably 0.5:1 to 1:1. Indeed, it is especially preferred that the support produced be substantially free of alumina.

Calcination of the cobalt impregnated support preferably is conducted in air at temperatures in the range of about 700° C. to about 1000° C., preferably about 800° C. to about 900° C.

Typically the support will have a surface area in the range of from about 5 $m^2/g$ to about 40 $m^2/g$ and preferably from 10 $m^2/g$ to 30 $m^2/g$. Pore volumes range from about 0.2 cc/g to about 0.5 cc/g and preferably from 0.3 cc/g to 0.4 cc/g.

In preparing the catalyst the cobalt and rhenium promoter are composited with the support by any of a variety of techniques well known to those skilled in the art, including impregnation (either co-impregnation with promoters or serial impregnation—either by spray drying or by the incipient wetness techniques). Since a preferred catalyst for fixed bed Fischer-Tropsch processes is one wherein the catalytic metals are present in the outer portion of the catalyst particle, i.e., in a layer no more than 250 microns deep, preferably no more than 200 microns deep, a preferred method of preparing the catalyst is the spray method which is described in U.S. Pat. No. 5,140,050, incorporated herein by reference or in EP 0,266,898, incorporated herein by reference. For slurry Fischer-Tropsch processes, catalysts are preferably made by incipient wetness impregnation of spray-dried supports. When using the incipient wetness impregnation technique, organic impregnation aids are optionally employed. Such aids are described in U.S. Pat. Nos. 5,856,260, 5,856,261 and 5,863,856, all incorporated herein by reference.

The amount of cobalt present in the catalyst will be in the range of 2 to 40 wt % and preferably 10 to 25 wt % while the rhenium will be present in weight ratios of about 1/20 to 1/10 of the weight of cobalt.

By selecting the appropriate Fischer-Tropsch reaction conditions, the appropriate catalyst, or both as described above the high $\alpha$ resulting product contains a greater amount of higher molecular weight material. Indeed a 700° F.+ fraction of the waxy product will have greater than about 15 wt % of hydrocarbons boiling in the 850° F.-1050° F. (454° C.-565° C.) range.

A cut containing the 700° F.+ fraction of the waxy product is separated from other hydrocarbons produced in the Fischer-Tropsch process and then is catalytically hydroisomerized. Thus, for example, a 450° F.+ (232° C.+) cut or higher is separated and catalytically hydroisomerized. Suitable hydroisomerization catalysts typically include a hydrogenating metal component such as a Group VI or Group VIII metal or mixture thereof on a refractory metal oxide support, preferably a zeolite support. The catalyst typically contains from about 0.1 wt % to about 5 wt % metal. Examples of such catalysts include a noble metal, e.g., Pt on ZSM-23, ZSM-35, ZSM-48, ZSM-57 and ZSM-22.

A preferred catalyst is Pt on ZSM-48. The preferred preparation of ZSM-48 is disclosed in U.S. Pat. No. 5,075,269 incorporated herein by reference. The Pt is deposited on the ZSM-48 by techniques well known in the art such as impregnation, either dry or by incipient wetness techniques.

Isomerization is conducted under conditions of temperatures between about 500° F. (260° C.) to about 900° F. (482° C.), preferably 550° F. (288° C.) to 725° F. (385° C.), pressures of 1 to 10,000 psi $H_2$, preferably 100 to 2,500 psi $H_2$, hydrogen gas rates of 50 to 3,500 SCF/bbl, and a space velocity in the range of 0.25 to 5 v/v/hr, preferably 0.5 to 3 v/v/hr.

Following isomerization, the isomerate is distilled into a distillate cut and a lube oil cut. For the purposes herein, the lube oil is that fraction boiling above about 700° F. (371° C.).

The lube oil is then extracted using a polar solvent in an amount sufficient to produce two liquid phases, viz a first light phase and a second heavy phase. The phases are then separated and the solvent is removed from the heavy phase to yield an extra heavy lube.

Preferably the solvent is removed from both phases and is recycled.

Suitable polar solvents include methyl ethyl ketone, methyl isobutyl ketone, acetone, n-methyl pyrolidone, dichloroethane and dichloromethane. Methyl ethyl ketone is the preferred polar solvent.

The temperature and pressure at which extraction may be conducted depends upon the choice of solvent. In general, temperatures may range from about −60° F. (−51° C.) to about 100° F. (38° C.) and pressures from about 5 psia to 500 psia. In the case of methyl ethyl ketone, for example, suitable temperatures range from about −60° F. (−51° C.) to about 90° F. (32° C.) at atmospheric pressures.

The extraction is conducted by mixing the heavy lube oil with the solvent to produce a dispersed liquid phase in a continuous liquid phase which after cessation of mixing undergo phase separation into the first light phase and a second heavy phase.

Mixing can be performed using paddle type mixers, interfacial mixing devices, rotating disc contactors and the like.

In an alternate embodiment multiple extractions may be performed thereby, in effect, fractionating the heavy lube oil into a plurality of product slates.

The invention will now be illustrated by the example which follows:

EXAMPLE

A heavy 1000° F.+ lube oil derived by hydroisomerization of a high alpha Fischer-Tropsch feed was subjected to success extractions with methyl ethyl ketone (MEK). The extraction was conducted by adding 16.4 g heavy lube oil to each of two 25 ml centrifuge tubes which were then filled with MEK. The tubes were well shaken by hand resulting in a fine dispersion of fine droplets. The tubes were centrifuged to produce a well-defined interface between the lower more viscous phase and the upper lighter phase. The MEK rich supernate phase was decanted with a pipette and the supernates from both tubes were combined. All mixing, centrifugation and decanting was done at room temperature. The MEK from the supernate was evaporated and then the samples were dried in a vacuum oven at 90° C. overnight.

Additional MEK was added to the material remaining in the tubes, to fill them up. The tubes were well shaken, and the centrifugation was repeated 26 times. Samples numbered 0-5 contained the combined supernate from both tubes. Samples numbered 6-15 contained the combined supernate from both tubes for two successive cycles. The sample numbered 16 is the remaining heavy phase after the last decantation. It was recovered from the tubes and the dissolved MEK was removed in a vacuum oven.

Gel Permeation Chromatography was run on the different fractions. The molecular weight averages Mz, Mw and Mn are given in the Table. The values in italics are interpolated values. The viscosity as a function of temperature from 25° C. to 85° C. was measured on a Bohlin Controlled Stress Rheometer for various shear stresses. Since the quantity of sample for some fractions were limited, pairs 0-1, 4-5 and 14-15 were combined to allow measurement of the viscosity.

The results are given in the Table below.

TABLE

| # | Lube wt, gms | Ms (1) | Mw (1) | Mn (1) | Vis @ 40° C., cP | Vis @ 100° C., cP | Vis @ 40° C., cSt | Vis @ 100° C. cSt | VI |
|---|---|---|---|---|---|---|---|---|---|
| 0 | 0.0592 | 725 | 681 | 650 | 73.3 | 11.1 | 91.6 | 13.9 | 154.7 |
| 1 | 0.0643 | 696 | 665 | 641 | | | | | |
| 2 | 0.0588 | 677 | 654 | 635 | | | | | |
| 3 | 0.0634 | *(695)* | *(675)* | *(645)* | | | | | |
| 4 | 0.0604 | 719 | 676 | 647 | 70.5 | 11.4 | 88.1 | 14.3 | 167.6 |
| 5 | 0.0543 | *(695)* | *(675)* | *(645)* | | | | | |
| 6 | 0.0495 | 698 | 668 | 644 | | | | | |
| 7 | 0.0435 | *(701)* | *(675)* | *(650)* | 72.8 | 11.6 | 91.0 | 14.5 | 165.9 |
| 8 | 0.0433 | 703 | 678 | 656 | 74.9 | 12.0 | 93.6 | 15.0 | 168.6 |
| 9 | 0.0411 | *(723)* | *(693)* | *(669)* | | | | | |
| 10 | 0.0376 | 751 | 717 | 689 | 85.8 | 13.3 | 107.3 | 16.6 | 168.3 |
| 11 | 0.0268 | 786 | 749 | 712 | | | | | |
| 12 | 0.0233 | 832 | 787 | 750 | 106.3 | 15.8 | 132.9 | 19.8 | 170.4 |
| 13 | 0.0169 | 877 | 843 | 797 | 123.6 | 18.3 | 154.5 | 22.9 | 177.2 |
| 14 | 0.0121 | 949 | 906 | 867 | 176.5 | 23.8 | 220.6 | 29.8 | 175.5 |
| 15 | 0.0078 | 1048 | 1002 | 959 | | | | | |
| 16 | 1.50 | 1390 | 1296 | 1214 | 371.7 | 45.8 | 464.6 | 57.3 | 192.6 |

(1) Value in italics are interpolations.

As can be seen the high molecular weight materials are concentrated in the fraction which has the highest viscosity. Also, the example demonstrates the ability to separate by liquid extraction an extra heavy lube base stock.

What is claimed is:

1. A method for separating extra heavy lube base stocks from heavy lube oils comprising:

treating the heavy lube oil with a polar solvent in an amount sufficient to form a first light liquid phase and a second heavy liquid phase;

separating the phases to produce a separate recovered first light liquid phase and a separate recovered second heavy liquid phase;

removing the solvent from the separate recovered second heavy liquid phase to obtain an extra heavy lube base stock having a kinematic viscosity at 100° C. of greater than about 15 cSt; and optionally removing the solvent from the separate recovered first light liquid phase, and recovering the removed solvent.

2. The method of claim 1 wherein the solvent is MEK.

3. The method of claim 2 wherein the treating comprises mixing sufficiently to form dispersed liquid droplets in a continuous liquid phase.

4. The method of claim 3 including permitting the droplets to coalesce to form a separable liquid phase.

5. The method of claim 4 wherein the heavy lube is a catalytically hydroisomerized cut of a 700° F.+ containing fraction of Fischer-Tropsch waxy product.

6. The method of claim 5 wherein the heavy lube oil is a catalytically hydroisomerized 450° F.+ of a Fischer-Tropsch waxy product.

7. A method for producing extra heavy lube base stocks comprising:

conducting a Fisher-Tropsch process under conditions sufficient to produce a product having a Schulz-Flory $\alpha$ greater than 0.9;

separating a cut from the product containing a 700° F.+ fraction;

catalytically hydroisomerizing the separated cut under hydroisomerization conditions to form an isomcrate;

separating a 700° F.+ (371° C.+) cut from the isomerate to obtain a heavy lube oil;

treating the heavy lube oil with a polar solvent in an amount sufficient to form a first light liquid phase and a second heavy liquid phase;

separating the phases to produce a separate recovered first light liquid phase and a separate recovered second heavy liquid phase; and removing the solvent from the separate recovered second heavy liquid phase to obtain an extra heavy lube base stock having a kinematic viscosity at 100° C. of greater than about 15 cSt.

8. The method of claim 7 wherein a 450° F.+ (232° C.+) cut containing a 700° F.+ fraction is separated and catalytically hydroisomerized.

9. The method of claim 7 or 8 wherein the polar solvent is MEK.

* * * * *